United States Patent [19]

Bodor

[11] 3,975,016

[45] Aug. 17, 1976

[54] INFLATABLE BALL

[76] Inventor: Steven Bodor, 6538 Fountain Ave., Los Angeles, Calif. 90028

[22] Filed: Dec. 16, 1974

[21] Appl. No.: 518,996

[52] U.S. Cl. ..... 273/58 R; 46/47; 273/65 C; 273/65 D; 273/1.5 A; 273/DIG. 20

[51] Int. Cl.[2] ..... A63B 41/00; A63B 41/12; A63H 1/32

[58] Field of Search ..... 273/58, 65 C, 65 R, 273/200, 95 A, 95 AA, 1.5 A, DIG. 20; 46/47

[56] References Cited

UNITED STATES PATENTS

| | | | |
|---|---|---|---|
| 1,892,727 | 1/1933 | Haubensak et al. | 273/65 C |
| 2,500,073 | 3/1950 | Hayes | 273/58 C |
| 3,724,853 | 4/1973 | Crowder | 273/95 A X |

FOREIGN PATENTS OR APPLICATIONS

| | | | |
|---|---|---|---|
| 1,162,827 | 9/1958 | France | 273/95 A |

*Primary Examiner*—George J. Marlo
*Attorney, Agent, or Firm*—Henry M. Bissell

[57] ABSTRACT

A ball adapted to be spun on the tip of the finger and have it whirl faster and longer due to a bearing inserted within the ball by means of an attached housing. The ball may be reinflated through an aperture in the bearing and a sealing valve member contained by the housing.

The parts comprising the bearing and its associated housing can all be molded of plastic also, making the entire assembly lighter and simpler to manufacture.

10 Claims, 11 Drawing Figures

INFLATABLE BALL

IN THE DRAWINGS

Figure 1:
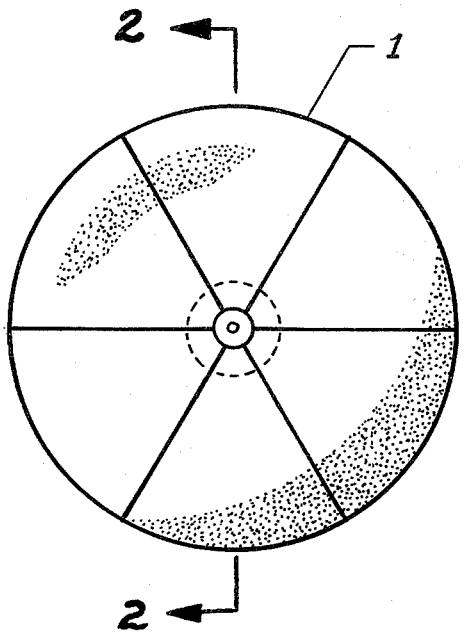
FIG. 1 is a view of the ball showing the aluminum housing mounting my invention inside the ball (dotted circular line) with the rotator for balancing.
Figure 2:
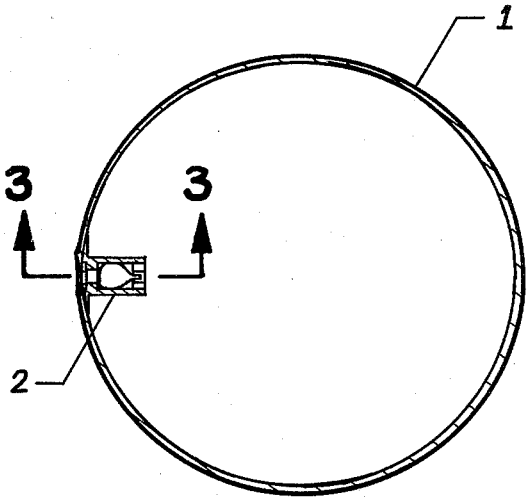
FIG. 2 is a cut-away view showing how the housing of the bearing and the inflator are attached.
Figure 3:
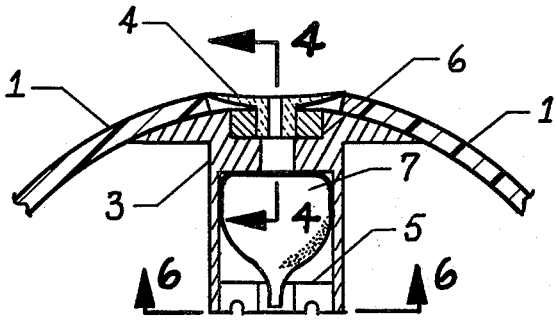

FIG. 3 is a sectional view taken along the line 3—3 of FIG. 2, showing the five parts that make up the housing assembly. These parts comprise the housing 3, the balancing rotator 4, the nut 5, the precision fit bearing 6 (a purchased part) and the inflator 7 (a purchased part).

Figure 4:
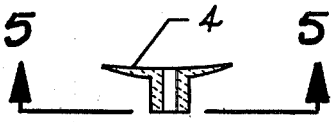

FIG. 4 is a cross section of the balancing rotator 4 that is inserted into the precision fit bearing 6. The small hole that goes all the way through is for inflating and deflating the ball.

Figure 5:
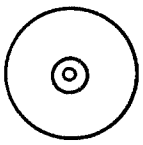

FIG. 5 shows a view looking at the bottom of the aluminum machined balancing rotator 4.

Figure 6:
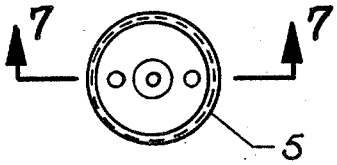
Figure 7:
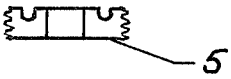

FIGS. 6 and 7 are respectively top and side elevation views of the aluminum machined and threaded nut 5.

Figure 8:
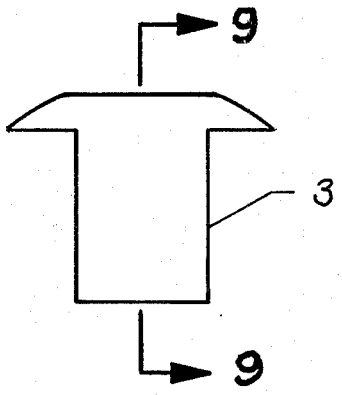
Figure 10:
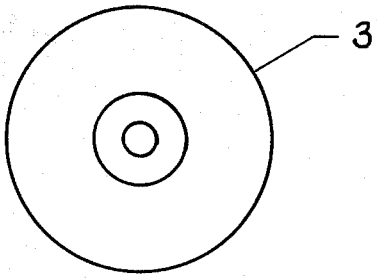
Figure 9:
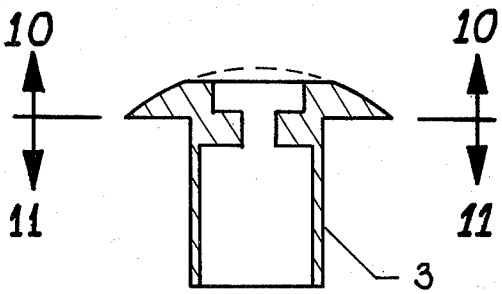

FIGS. 8, 9 and 10 are respectively front elevation, cross sectional, and plan views of the housing of FIG. 3.

Figure 11:
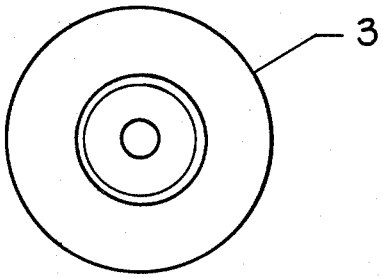

FIG. 11 is a bottom view of the housing of FIGS. 8–10 with the inflator member in place.

As indicated above the housing 3, the balancing rotator 4 and the nut 5 can also be manufactured out of plastic or the like, thus making the product even lighter, simpler to fabricate and easier to use.

In use, a ball equipped with an integral pivot bearing in accordance with my invention is set spinning in an attitude upside down from the orientation shown in FIG. 3 and with the balancing rotator 4 customarily supported on the extended index finger of the user. Since the rotator 4 is mounted within the precision fit bearing 6 which itself is mounted in the ball 1 by means of the housing 3 attached thereto, there is relative rotation of the ball 1 and associated bearing 6 and housing 3 with respect to the rotator 4. As a result, the rotator 4 stays in place, supporting the entire assembly of bearing, housing and ball on the extended index finger of the user, thereby permitting the user to emulate a stunt which is often performed by skilled basketball players and the like who take a conventional basketball and are able to balance it while spinning it on the tip of their index finger. This stunt, when performed with a conventional inflated ball, requires a fair amount of skill, whereas when performed with a ball and rotator assembly of my invention may be accomplished with ease by almost anyone. The rotator 4 is so designated to signify its relationship of relative rotation with respect to the bearing 6 and attached housing 3 and ball 1; however, it will be understood that, in intended use, the ball will be rotated (spun) about the rotator which itself is stationary.

As shown in FIGS. 3, 4 and 5, the rotator 4 includes an extended circular base section outside of the bearing 6 and generally in line with the cover of the ball 1 but slightly recessed relative to the outer circumferential surface of the ball 1. Thus, the rotator 4 inserted in the bearing 6 within the attached housing 3 inside the cover of the ball 1 has its extended circular portion positioned within the opening of the ball 1 and accessible to the user, both for supporting the rotator 4 on his index finger when playing with the ball of the invention and for inflating or deflating the ball 1 through the central bore openings of the rotator 4, housing 3 and nut 5 as shown particularly in FIG. 3 and described hereinabove.

As shown in FIG. 3, and indicated hereinabove, the inflator 7 is a commercially-available part which is held in place within the housing 3 by the nut or retaining member 5, thus acting as a valve or sealing member controlling the inflation of the ball 1. The nut or retaining member 5 is provided with a central opening (see FIG. 6) to pass air therethrough between the interior and exterior of the ball.

I claim:

1. The combination of an inflatable ball and integral pivot bearing comprising:
   - an inflatable ball;
   - a bearing housing affixed adjacent an aperture in the ball interiorly of the ball and having a corresponding opening aligned with said aperture;
   - a rotator positioned in substantial alignment with the opening and having an exposed portion accessible to a user therethrough; and
   - a bearing mounted in the housing adjacent said aperture and mounting the rotator therein so as to permit spinning of the ball while the rotator is supported on the user's finger, the exposed accessible portion of the rotator being recessed relative to the outer circumferential surface of the ball.

2. The combination of claim 1 wherein the rotator comprises a hollow bore, centrally positioned and aligned with the corresponding opening in the housing for transmitting the air therethrough for inflating or deflating the ball.

3. The combination of claim 2 wherein the rotator further comprises a circumferentially-extended base section outside of the bearing member and generally in line with the exterior cover of the ball.

4. The combination of claim 3 wherein the rotator is shaped with a concave exterior surface configured for support upon the finger tip of the user.

5. The combination of claim 4 wherein the section of the housing supporting the bearing is generally shaped as a spherical section with an exterior curved surface having a radius of curvature approximating that of the interior surface of the cover of the ball to facilitate the mounting of the housing within the ball.

6. The combination of claim 2 wherein the housing further includes a valve for controlling the passage of air through the housing between the interior and exterior of the ball.

7. The combination of claim 6 wherein the valve comprises a sealing member releasably mounted across the housing opening.

8. The combination of claim 7 further including a retaining member mounted in the housing on the side thereof remote from said opening for retaining the sealing member in position adjacent the opening.

9. The combination of claim 8 wherein the retaining member includes an aperture for permitting the passage of air therethrough to and from the housing opening via the sealing member.

10. The combination of claim 9 wherein the retaining member is adapted to threadably engage said housing.

* * * * *